US007997284B1

(12) United States Patent
Tanner

(10) Patent No.: US 7,997,284 B1
(45) Date of Patent: Aug. 16, 2011

(54) HAIR COLORING FOIL AND METHOD

(76) Inventor: Tammie J. Tanner, Weatherford, TX (US)

( * ) Notice: Subject to any disclaimer, the term of this patent is extended or adjusted under 35 U.S.C. 154(b) by 801 days.

(21) Appl. No.: 11/949,281

(22) Filed: Dec. 3, 2007

Related U.S. Application Data

(63) Continuation-in-part of application No. 10/720,968, filed on Nov. 24, 2003, now abandoned.

(60) Provisional application No. 60/510,088, filed on Oct. 10, 2003.

(51) Int. Cl.
*A61K 8/18* (2006.01)

(52) U.S. Cl. ..... 132/208; 132/222; 132/270

(58) Field of Classification Search ..... 132/200–211, 132/270, 222
See application file for complete search history.

(56) References Cited

U.S. PATENT DOCUMENTS

| | | | | |
|---|---|---|---|---|
| 3,871,388 A | | 3/1975 | Leoci | |
| 4,196,741 A | | 4/1980 | Minghenelli | |
| 4,637,411 A | * | 1/1987 | Sanders | 132/212 |
| 5,287,864 A | * | 2/1994 | Gallo | 132/208 |
| 5,335,679 A | | 8/1994 | Baxter | |
| 5,662,128 A | | 9/1997 | Habibi | |
| 5,664,590 A | | 9/1997 | Plateroli et al. | |
| 5,816,268 A | | 10/1998 | Awaijane | |
| 6,041,128 A | | 3/2000 | Narisawa et al. | |
| 6,863,076 B2 | | 3/2005 | Russell | |
| 2004/0118424 A1 | * | 6/2004 | Russell | 132/208 |

* cited by examiner

*Primary Examiner* — Todd E Manahan
*Assistant Examiner* — Brianne O'Neill
(74) *Attorney, Agent, or Firm* — Eric Karich

(57) ABSTRACT

A method for coloring hair using a hair coloring foil includes the following steps: providing a hair coloring foil that has a front surface and a top edge, first and second hair gripping hook strips positioned on the front surface of the foil adjacent to and in parallel with the top edge. The foil is positioned around a handle of a comb such it is positioned between the first and second hair gripping hook strips. The handle is pushed into the hair of a subject adjacent the roots of the hair, such that the first hair gripping hook strips grip a first set of hair strands by the roots, and the second hair gripping hook strip grips a second set of hair strands. A coloring agent is then applied to the second set of hair strands, and the foil is folded to enclose the second set of hair strands.

1 Claim, 3 Drawing Sheets

HAIR COLORING FOIL AND METHOD

CROSS-REFERENCE TO RELATED APPLICATIONS

This application for a utility patent is a continuation-in-part of a previously filed utility patent, now abandoned, having the application Ser. No. 10/720,968, filed Nov. 24, 2003 now abandoned. This application also claims the benefit of U.S. Provisional Application No. 60/510,088, filed Oct. 10, 2003.

BACKGROUND OF THE INVENTION

1. Field of the Invention

This invention relates generally to the field of hair styling, and more particularly to a novel foil and method for coloring hair.

2. Description of Related Art

The coloring, highlighting, and frosting of hair are popular methods of altering or accenting the color and/or look of a person's hair. In a typical hair coloring process, a patient's hair is carefully painted with a coloring agent including a liquid dye or bleach. Various tools are used to accurately control which strands of hair are subjected to the coloring agent and which are not.

The common foil method of coloring hair involves the use of rectangular sheets of aluminum foil. A rectangular sheet of aluminum foil is held against a subject's head, and set of the subject's hair strands located above the sheet are selected and positioned on the sheet. After a liquid coloring agent is applied to the selected set of hair strands, the sheet of aluminum foil is folded to enclose the treated set of hair strands. The above process is repeated for each set of hair strands to be treated.

A problem arises with the foil method in that the sheets of aluminum foil have a tendency to move or slip during and after the application of the liquid coloring agent, and the coloring agent sometimes drips or otherwise escapes from the sheets of aluminum foil. When the escaped coloring agent contacts portions of non-selected strands of the subject's hair, the result is an undesirable spotted, uneven look.

The state of the art in the present field is described in Russell, U.S. Pat. No. 6,863,076, which teaches a foil used for coloring hair that includes an elongate strip of hooked material on either side of the foil to facilitate placement of the foil in the subject's hair. A pinked upper edge of the foil is pushed upwardly into the subject's hair, and the hooked material captures the hair to hold the hair in place.

The disadvantage of this arrangement is that the foil has little rigidity, and is difficult to push deep into the subject's hair, into the roots. Since it is advantageous to position the foil deep into the subject's hair, into the roots, this can be a difficult problem to overcome. Yet this problem cannot be overcome with the Russell foil, because the gripping strips are on opposite sides of the foil.

It would be advantageous to have a foil and method for coloring hair that enables a stylist to quickly and easily position the foil deep into the roots of the subject's hair, and to reduce the tendency of thin sheets to crumble, or to slip during and after application of a liquid coloring agent.

SUMMARY OF THE INVENTION

The present invention teaches certain benefits in construction and use which give rise to the objectives described below.

The present invention provides a method for coloring hair using a comb having a handle, and a novel hair coloring foil.

The hair coloring foil includes a front surface and a top edge, a first hair gripping hook strip positioned on the front surface of the foil, and a second hair gripping hook strip positioned on the front surface of the foil adjacent the first hair gripping hook strip. The first hair gripping hook strip is arranged adjacent to and in parallel with the top edge, and the second hair gripping hook strip is also parallel with the top edge and the first hair gripping hook strip. The first and second hair gripping hook strips are spaced apart to allow the foil to be folded between the first and second hair gripping hook strips. The method includes the steps of folding the foil around the handle of the comb such that the handle is positioned between the first and second hair gripping hook strips, thereby producing a fold that divides the foil into an upper portion and a lower portion; pushing the handle of the comb into the hair of a subject adjacent the roots of the hair, such that the first hair gripping hook strips grip a first set of hair strands by the roots; selecting a second set of hair strands adjacent to the fold; positioning the second set of hair strands upon the lower portion of the foil such that the second hair gripping hook strip attached to the lower portion of the foil grips at least a portion of the second set of hair strands; applying a coloring agent to the second set of hair strands; and folding the foil to enclose the second set of hair strands.

A primary objective of the present invention is to provide a method for coloring hair having advantages not taught by the prior art.

Another objective is to provide a method for coloring hair that utilizes a hair coloring foil that includes first and second hair gripping hook strips that are both positioned on a front surface of the foil, so that the foil may be folded around a handle of a comb, which enables the foil to be forced deep into a subject's hair, adjacent the roots of the hair.

A further objective is to provide a method for positioning the novel hair coloring foil, using a handle of a comb, into the roots of a subject's hair, for superior coloring results that reach deep into the roots of a subject's hair.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
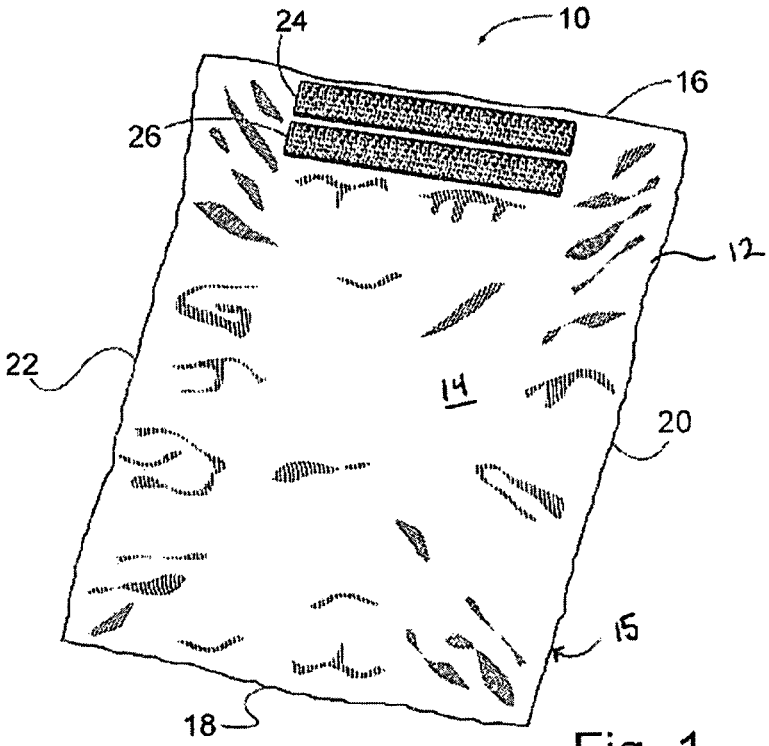
FIG. 1 is a perspective view of one embodiment of a hair coloring foil including a flexible foil and a pair of hair grippers attached to the flexible foil.

FIG. 1 is a perspective view of one embodiment of a hair coloring foil 10. In the embodiment of FIG. 1, the foil 12 is a substantially rectangular sheet of aluminum foil having a front side 14 and an opposed back side 15, a top edge 16 and an opposed bottom edge 18, a right edge 20 and an opposed left edge 22. In the embodiment of claim 1, the top edge 16 and the bottom edge 18 are substantially linear and parallel to one another, and the right edge 20 and the left edge 22 are substantially linear and parallel to one another. While FIG. 1 illustrates the preferred embodiment, the term foil is hereby defined to include other suitable substrates that facilitate this type of hair coloring method, and in any shape that is suitable for the procedure.

In the embodiment of FIG. 1, the hair coloring foil 10 also includes first and second hair gripping hook strips 24 and 26 for gripping strands of hair. As shown in FIG. 1, the hair gripping hook strips 24 and 26 are arranged in parallel to one another and attached (e.g., adhesively attached) to the front surface 14 of the foil 12 adjacent to the top edge 16. The hair gripping hook strips 24 and 26 are spaced apart to allow the foil 12 to be folded between the hair gripping hook strips 24 and 26. While we describe the relationship between the hair gripping hook strips 24 and 26 as parallel, this should be construed to mean only a generally parallel relationship and does not require a geometrically precise parallel relationship.

In the embodiment of FIG. 1, the foil 12 is a sheet of aluminum foil. In general, the foil 12 may be formed from any sheet material that is substantially impermeable to liquids, substantially retains its shape when folded, and does not deleteriously react with a selected coloring agent. In other embodiments, the foil 12 may be formed from a sheet material including paper and/or plastic that is substantially impermeable to liquids and suitable for the described use.

In the embodiment of FIG. 1, the hair gripping hook strips 24 and 26 are hook portions of a hook and loop fastener assembly, such as Velcro®. In general, hook and loop fastener assemblies have two portions: a hook portion and a loop portion. The hook and loop portions are typically sold as tapes. The hook portion has many tiny hook-shaped members (i.e., hooks) extending from an outer surface. In the embodiment of FIG. 1, the many small hooks of the hair gripping hook strips 24 and 26 are used for gripping strands of hair. Other forms of hooks, teeth, or similar features may also be used.

In the embodiment of FIG. 1, the hair gripping hook strips 24 and 26 are substantially rectangular and have opposed major top and bottom edges and opposed minor right and left edges. The top and bottom edges are substantially linear and parallel to one another, and the right and left edges are substantially linear and parallel to one another. In the embodiment of FIG. 1, the top and bottom edges of the hair gripping hook strips 24 and 26 are substantially parallel to the top edge 16 of the foil 12.

FIGS. 2-5 will now be used to illustrate a method for coloring hair using the hair coloring foil 10 of FIG. 1.

Figure 2:
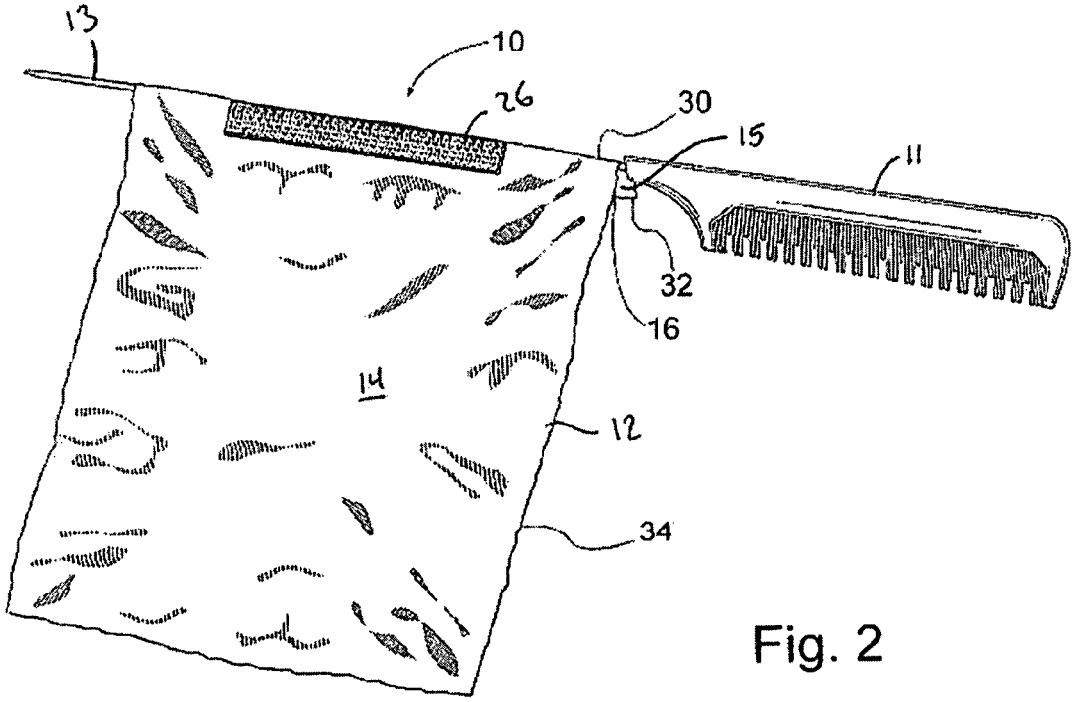
FIG. 2 is a perspective view of the hair coloring foil of FIG. 1 following folding of the foil between the hair grippers, wherein a resulting fold divides the foil into an upper portion and a lower portion.

FIG. 2 is a perspective view of the hair coloring foil 10 of FIG. 1, following folding of the foil 12 between the hair gripping hook strips 24 and 26. As shown in FIG. 2, the foil 12 is folded around a handle 13 of a comb 11. For purposes of this application, the terms comb and handle are defined to include any implement that functions as shown and described. A comb 11 is currently preferred because it is a tool already being used by the stylist.

When the foil 12 is folded between the hair gripping hook strips 24 and 26 as shown in FIG. 2, a resulting fold 30 is substantially parallel to the top edge 16 of the foil 12 and divides the foil 12 into an upper portion 32 and a lower portion 34. The hair gripper 24, attached to the upper portion 32 of the foil 12 adjacent to the fold 30, is attached to a first set of hair strands, and a second set of hair strands adjacent to the fold 30 is selected.

Figure 3:
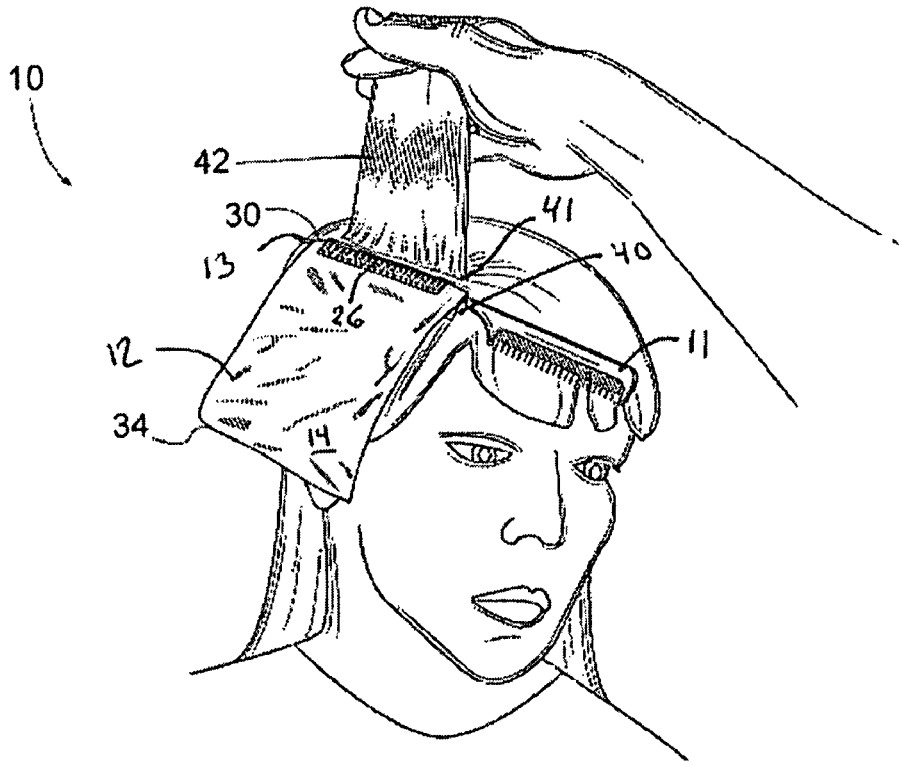
FIG. 3 is a perspective view of the hair coloring foil of FIG. 2 following attaching of the hair gripper attached to the upper portion of the foil to a first set of hair strands, and following the selecting of a second set of hair strands adjacent to the fold.

FIG. 3 is a perspective view of the hair coloring foil 10 of FIG. 2 once the comb 11 has been used to push the foil 12 into the subject's hair. The comb 11 provides enough rigidity to the fold 30 so that it may be pushed deep into the roots 41 of the subject's hair, unlike prior art methods that rely on the rigidity of the foil for such an operation. The first hair gripping hook strip 24 engages a first set of hair strands 40, and helps stabilize the foil 10.

The stylist then selects a second set of hair strands 42 adjacent to the fold 30. The second set of hair strands 42 may be selected in a single unit, as shown, or it may be selected by "weaving" only certain sections of the hair, as is well known in the art. As shown in FIG. 3, the second set of hair strands 42 is preferably initially "overdirected" towards the top of the head so as to enable the foil 10 to be more closely fitted adjacent the scalp, and into the roots 41.

Figure 4:
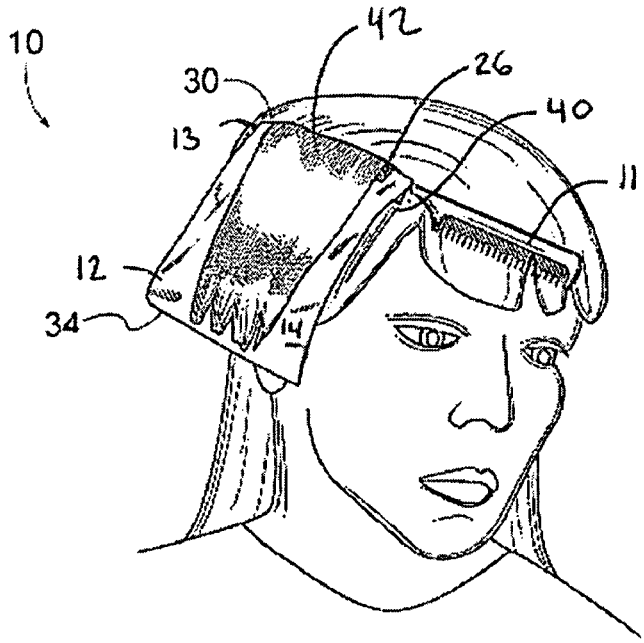
FIG. 4 is a perspective view of the hair coloring foil of FIG. 3 following positioning of the second set of hair strands upon the lower portion of the foil such that the hair gripper attached to the lower portion of the foil grips some or all of the second set of hair strands, and following application of a coloring agent to the second set of hair strands.

FIG. 4 is a perspective view of the hair coloring foil 10 of FIG. 3 following positioning of the second set of hair strands 42 upon the lower portion 34 of the foil 12 such that the second hair gripping hook strip 26, attached to the lower portion 34, grips some or all of the second set of hair strands 42, and following application of the coloring agent to the second set of hair strands 42. The second set of hair strands 42 is then positioned upon the lower portion 34 of the foil 12 such that the second hair gripping hook strip 26, attached to the lower portion 34, grips some or all of the second set of hair strands 42. A coloring agent is applied to the second set of hair strands 42. The coloring agent may be, for example, a liquid dye or a liquid bleach.

The coloring agent is preferably applied such that the coloring agent contacts all of the hair stands of the second set of hair strands 42. For example, the coloring agent may be applied to the front side 14 of the foil 12, and/or a side of the second set of hair strands 42 adjacent to the front side 14 of the foil 12, prior to the positioning of the second set of hair strands 42 on the lower portion 34 of the foil 12. Following the positioning of the second set of hair strands 42 on the lower portion 34, the coloring agent may also be applied to a now accessible opposite side of the second set of hair strands 42.

The foil 12 is then folded to enclose the second set of hair strands 42. For example, the bottom edge 18 (FIG. 1) of the foil 12 may be raised up to a position near the fold 30, thereby folding the lower portion 34 of the foil 12 substantially in half. A bottom edge of the resulting folded lower portion 34 may again be raised up to fold the lower portion 34 a second time. Right edges of the folded lower portion 34 may be brought inward to form right side folds, and left edges of the folded lower portion 34 may be brought inward to form left side folds. The resulting enclosure formed by folding the lower portion 34 of the foil 12 has a relatively small volume, contains the treated second set of hair strands 42, and prevents the coloring agent from contacting hair strands other than those of the second set of hair strands 42.

Figure 5:
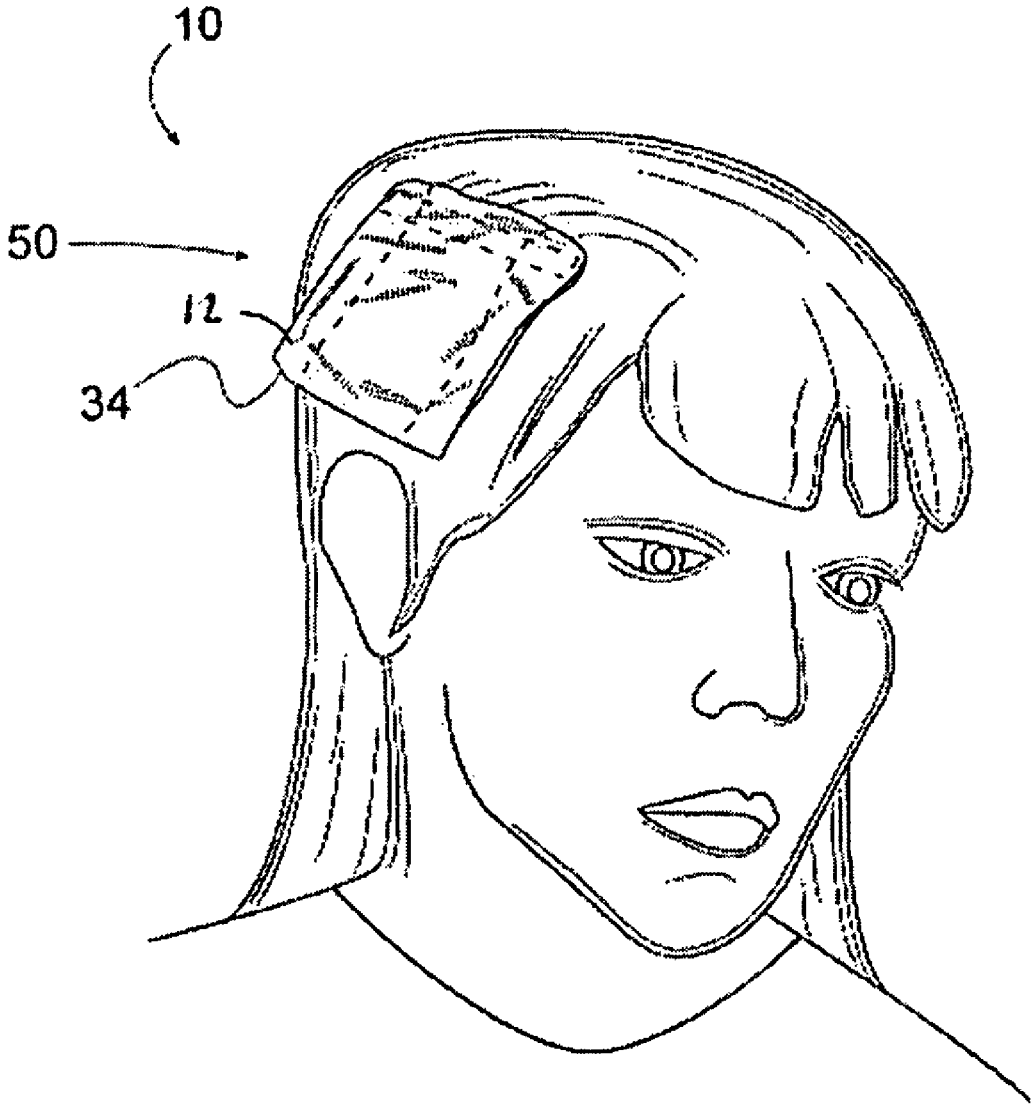
FIG. 5 is a perspective view of the hair coloring foil of FIG. 4 following folding of the lower portion of the foil to enclose the treated second set of hair strands.

FIG. 5 is a perspective view of the hair coloring apparatus 10 of FIG. 4 following the folding of the lower portion 34 of the substrate 12 to enclose the treated second set of hair strands 42. Secured to both the first set of hair strands 40 and the second set of hair strands 42, the resulting enclosure, formed by the folding and labeled 50 in FIG. 5, has little tendency to move or slip. As a result, the coloring agent is less likely to escape the enclosure 50 and contact portions of non-selected strands of hair.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for coloring hair, the method comprising the steps of:

providing a comb having a handle;

providing a hair coloring foil, comprising:

a flexible foil having a front surface, a bottom edge, and a top edge;

a first hair gripping hook strip positioned on the front surface of the foil, wherein the first hair gripping hook strip is arranged adjacent to and in parallel with the top edge;

a second hair gripping hook strip positioned on the front surface of the foil adjacent the first hair gripping hook strip, wherein the second hair gripping hook strip is also parallel with the top edge and the first hair gripping hook strip;

wherein the first and second hair gripping hook strips are both closer to the top edge than the bottom edge, and are spaced apart to allow the foil to be folded between the first and second hair gripping hook strips around the handle of the comb;

folding the foil around the handle of the comb such that the handle is positioned between the first and second hair gripping hook strips and such that the front surface and both the first and second hair gripping hook strips face outwardly, thereby producing a fold that divides the foil into an upper portion and a lower portion, with both the first and second hair gripping hook strips are adjacent to and on either side of the fold;

pushing the handle of the comb into the hair of a subject adjacent the roots of the hair, such that the first hair gripping hook strips grip a first set of hair strands by the roots;

selecting a second set of hair strands adjacent to the fold;

positioning the second set of hair strands upon the lower portion of the foil such that the second hair gripping hook strip attached to the lower portion of the foil grips at least a portion of the second set of hair strands;

applying a coloring agent to the second set of hair strands; and folding the foil to enclose the second set of hair strands.

* * * * *